US007780488B2

(12) United States Patent
Robertson

(10) Patent No.: US 7,780,488 B2
(45) Date of Patent: Aug. 24, 2010

(54) FLEX CONNECT

(75) Inventor: George Braxton Robertson, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/420,937

(22) Filed: Apr. 9, 2009

(65) Prior Publication Data

US 2009/0311920 A1 Dec. 17, 2009

Related U.S. Application Data

(60) Provisional application No. 61/060,617, filed on Jun. 11, 2008.

(51) Int. Cl.
*H01R 11/01* (2006.01)

(52) U.S. Cl. ..... 439/777; 439/883

(58) Field of Classification Search ..... 439/777, 439/877, 883

See application file for complete search history.

(56) References Cited

U.S. PATENT DOCUMENTS

| | | | | |
|---|---|---|---|---|
| 1,989,893 | A * | 2/1935 | Taylor | 439/502 |
| 2,286,097 | A | 6/1942 | Johnson | |
| 2,930,836 | A | 3/1960 | Floyd, Jr. | |
| 2,968,788 | A | 1/1961 | Neaderland et al. | |
| 2,982,808 | A | 5/1961 | Schwester | |
| 3,015,683 | A | 1/1962 | O'keefe et al. | |
| 3,123,663 | A | 3/1964 | Muldoon | |
| 3,622,685 | A | 11/1971 | Crowl | |
| 4,487,995 | A | 12/1984 | Hurwitz | |
| 4,834,682 | A | 5/1989 | Auclair et al. | |
| 5,188,544 | A | 2/1993 | Mukai | |
| 5,317,109 | A | 5/1994 | Aldissi | |
| 5,408,743 | A | 4/1995 | Tournier et al. | |
| 5,655,936 | A | 8/1997 | Meredith | |
| 5,759,055 | A | 6/1998 | Colantuano et al. | |
| 5,842,894 | A | 12/1998 | Mehlberg | |
| 7,081,027 | B2 | 7/2006 | Woodward | |
| 7,241,185 | B1 * | 7/2007 | Cecil et al. | 439/730 |
| 7,578,711 | B2 * | 8/2009 | Robinson | 439/801 |

OTHER PUBLICATIONS

The Homac Companies, Feb. 2002 Catalog, p. 108.

* cited by examiner

*Primary Examiner*—Khiem Nguyen
(74) *Attorney, Agent, or Firm*—Hoffmann & Baron, LLP

(57) ABSTRACT

The present invention relates generally to connectors for terminating and connecting electrical wires and cables. More particularly, the connector of the present invention permits ease of connection at any angle, with regard to the electrical wire or cable equal to that of heavy gauge. Termination of an electrical wire is provided in the present invention using a connector assembly including a barrel connector, a terminal lug connector, and a flexible cable. The terminal lug connector and the barrel connector mechanically and electrically engage the electrical wire. The flexible cable mechanically and electrically connects the barrel connector to the terminal lug connector and permits angular movement between the barrel connector and the terminal lug connector.

6 Claims, 3 Drawing Sheets

FLEX CONNECT

CROSS REFERENCE TO RELATED APPLICATIONS

This application claims priority to U.S. Provisional Patent Application No. 61/060,617 filed on Jun. 11, 2008, the contents of which are incorporated herein by reference in their entirety.

FIELD OF INVENTION

The present invention relates generally to connectors for terminating and connecting electrical wires and cables. More particularly, the present invention relates to a connector, which permits ease of connection at any angle with regard to the electrical wire or cable equal to that of heavy gauge.

BACKGROUND

Electrical wires are typically terminated with an electrical connector so as to permit connection with other wires or terminations. Quite often the termination may be positioned at an angle with regard to the extending wire. This would require the electrical wire to be bent to effect such connection.

When installing heavy gauge electrical wires, it is often difficult to bend the wires to make a connection. The physical characteristics of heavy gauge wires limit the radius of the bend that can be made. In some cases, bent lug connectors are used to make tight bends with heavy gauge electrical wires that cannot be easily bent. The drawbacks of previous connectors are that they have a fixed orientation and can only accommodate wires coming from a limited number of different directions.

There are also other bent lug connectors, which are made to connect wires oriented over a 360 degree range and at different angles. These bent lug connectors however may often need to be specially ordered, and that can cause down time on the job.

Accordingly, it is desirable to provide a connector that is flexible and can be installed at any angle with little effort, yet be readily available to the installer.

SUMMARY OF THE INVENTION

The present invention provides a connector assembly for terminating an electrical wire including a terminal lug connector, a barrel connector, and a flexible cable. The terminal lug connector and the barrel connector mechanically and electrically engage the electrical wire. The flexible cable mechanically and electrically connects the barrel connector to the terminal lug connector and permits angular movement between the barrel connector and the terminal lug connector.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF DRAWINGS

Figure 1A:
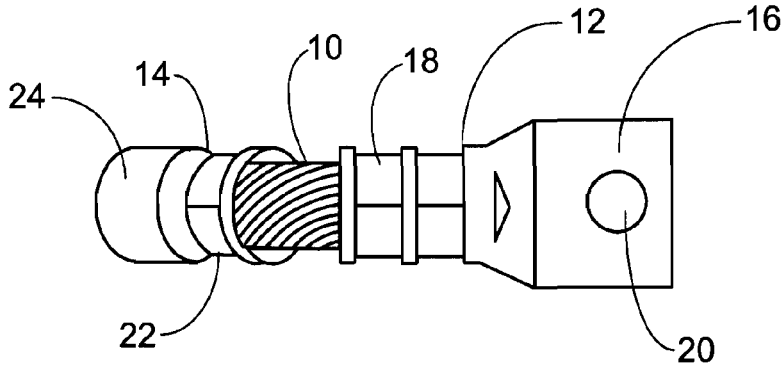
FIGS. 1A, 1B, 1C, and 1D show a connector assembly with a top and end view of the terminal lug connector with one aperture and bent at different angles.
Figure 1B:
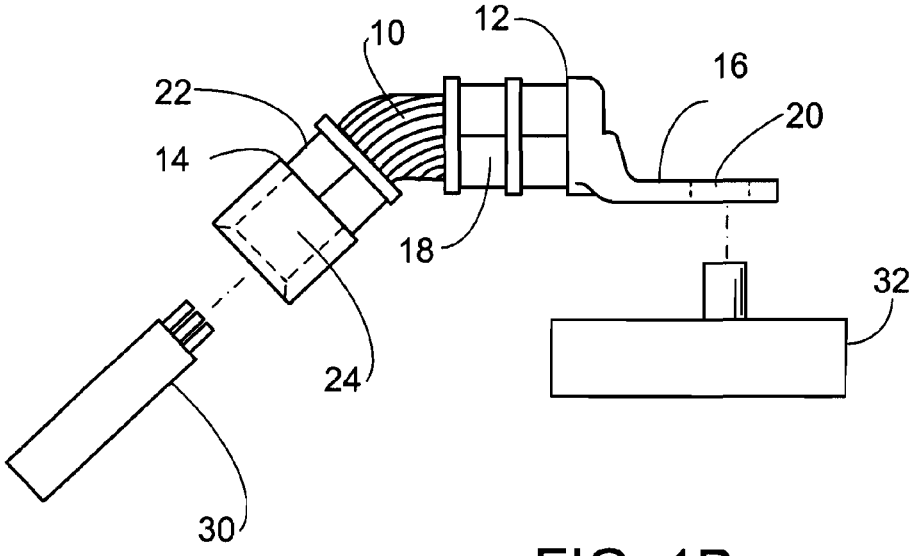
Figure 1C:
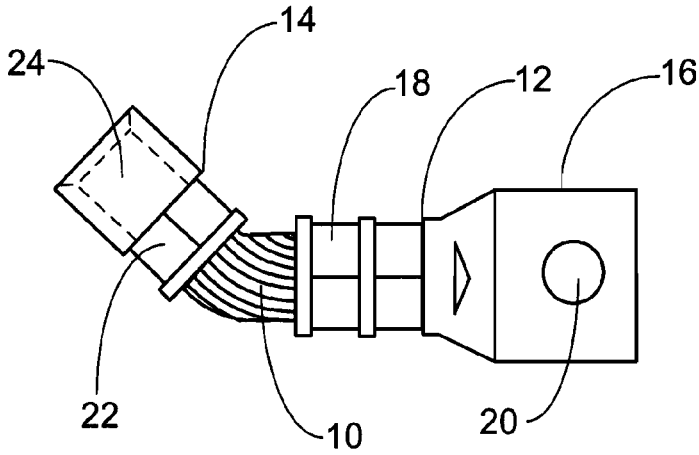
Figure 1D:
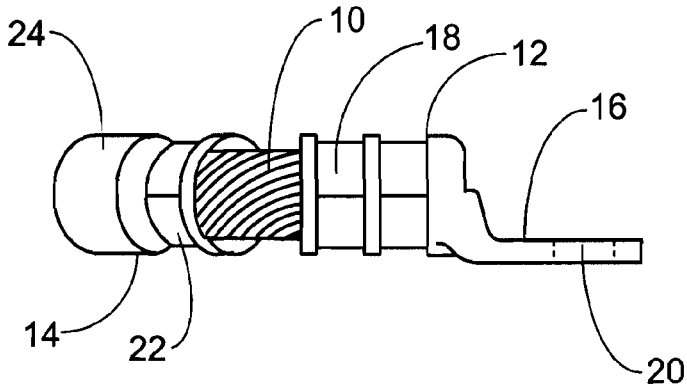

The present invention provides a connector, which allows termination and connection of a wire at a wide variety of angles with very little effort.

In the preferred embodiments, a connector assembly includes at least two lug connectors with a flexible cable 10 therebetween.

FIGS. 1A, 1B, 1C, and 1D show a preferred embodiment of the connector assembly of the present invention. The preferred embodiment includes a flexible cable 10, a terminal lug connector 12, and a barrel connector 14. The terminal lug connector 12 is preferably factory crimped to one end of the flexible cable 10, while the barrel connector 14 is preferably factory crimped to an opposing end of the flexible cable 10.

The flexible cable 10 is an electrically conductive cable that is flexible. An example is a braided cable. The present invention also contemplates using a flexible cable 10 constructed of other flexible and electrically conductive materials.

The terminal lug connector 12 includes a flat blade 16 and a barrel portion 18. The flat blade 16 may contain one aperture 20 or more than one and terminates the connection using connector bolts (not shown). The barrel portion 18 is connected to the flexible cable 10. The terminal lug connectors 12 are constructed from an electrically conductive metal, preferably cooper or aluminum and may be plated with a metal, such as tin. Moreover, the terminal lug connectors 12 used may be coated or covered with an electrically insulating material.

Terminal lug connectors 12 are available in a variety of sizes and the user selects a terminal lug connector 12 based on the specific application. For example, high voltage applications, which use large size electrical wires, require large terminal lug connectors 12. The selection of the appropriate sized terminal lug connector 12 required for an application would be within the knowledge of one of ordinary skill in the art.

The barrel connector 14 includes two opposed barrel ends 22, 24. One end of the barrel 22 is connected to the flexible cable 10 and the opposing end of the barrel 24 is connected to the electrical wire 30. Like the terminal lug connectors 12, the barrel connectors 14 are preferably constructed of cooper or aluminum, but other electrically conductive metals may be used. Additionally, the barrel connectors 14 may be plated with a metal, such as tin, and the barrel connectors 14 may also be coated or covered with an electrically insulating material.

The size of the barrel connector 14 selected for an application will depend on the electrical wires used in the specific application. One of ordinary skill in the art will have the knowledge to select an appropriate sized barrel connector 14.

The connector assembly in the preferred embodiment can be installed by connecting the terminal lug connector 12 end of the connector assembly to a motor, battery, or other device 32. Then the heavy gauge electrical wire 30 can be inserted at almost any angle into said other end of said barrel 14 and crimped by the installer to secure the electrical wire 30 to the connector assembly. The flexible cable 10 allows angular movement between said barrel connector 14 and terminal lug connector 12.

Figure 2A:
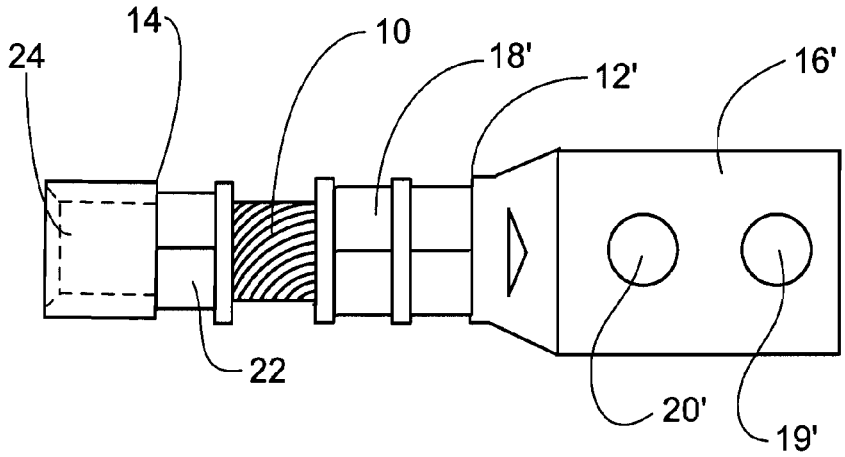
FIGS. 2A and 2B show a connector assembly with a top and end view of the terminal lug connector with two apertures.
Figure 2B:
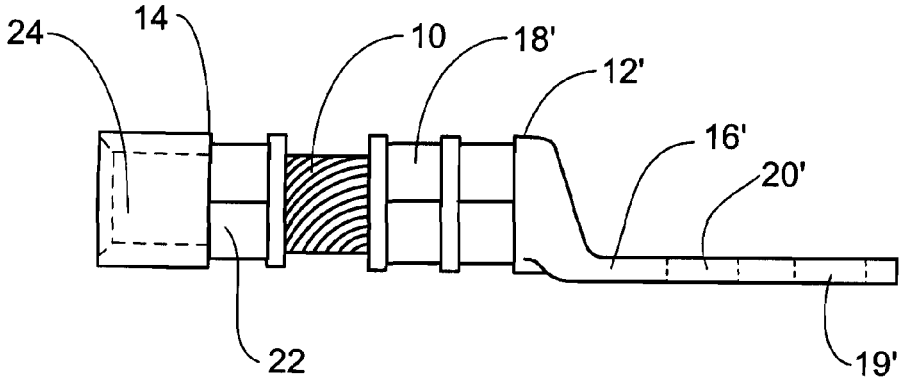

An alternative embodiment of the terminal lug connector 12' may include a flat blade 16' with two apertures 19', 20' and a barrel portion 18', as shown in FIGS. 2A and 2B. This embodiment is used when the terminal lug connector 12' is to be connected by two connector bolts (not shown).

A benefit of this invention is that the flexible cable 10 allows flexibility between the terminal lug connector 12 and the barrel connector 14. This is an improvement over previous methods used, which included bending electrical wires and causing stress on the wire and/or connector. Another advantage of this invention is that it can be used instead of an already bent connector, preventing down time on a job when the bent connector is a special order.

Yet another advantage is that the present connector assembly allows easier installation because the design uses lug connectors that are preferably connected to the flexible cable 10 in the factory. The installer is then only required to crimp the barrel connector 14 to the electrical wires being installed. A further advantage of the design is dampening of any vibration that may occur at the lug connection. By no longer subjecting the electrical wire 30 to such vibrations, the connector assembly eliminates any wearing or abrasion of the insulation that would otherwise occur.

Various changes to the foregoing described and shown structures will now be evident to those skilled in the art. Accordingly, the particularly disclosed scope of the invention is set forth in the following claims.

The invention claimed is:

1. A connector assembly for terminating an electrical wire comprising:

a barrel connector having two opposed barrel ends, one of said barrel ends insertably accommodating said electrical wire for crimpable mechanical and electrical engagement therewith;

a terminal lug connector having a connection end for mechanical termination to an electrical device and an opposed barrel portion; and a flexible cable having two opposed ends, said flexible cable crimped at one end to said barrel portion of said terminal lug connector and at the other end of said flexible cable to the other end of said barrel connector, said flexible cable being designed to permit angular movement between said barrel connector and said terminal lug connector so as to permit angular connection between said electrical wire and said electrical device.

2. A connector assembly of claim 1 wherein said flexible cable is an elongated member.

3. A connector assembly of claim 1 wherein said connection end of said terminal lug connector includes a flat blade.

4. A connector assembly of claim 3 wherein said terminal lug connector includes said flat blade having at least one connector aperture there through.

5. A connector assembly of claim 1 wherein said flexible cable is a braided cable.

6. A connector assembly of claim 1 wherein said terminal lug connector and said barrel connector are at least partially coated with an electrically insulating material.

* * * * *